US005754000A

United States Patent [19]

Skilton et al.

[11] Patent Number: 5,754,000

[45] Date of Patent: May 19, 1998

[54] APPARATUS FOR PROVIDING RADIATION

[75] Inventors: Christopher Thomas Skilton, Saxmundham; Paul Hanlon James Beatty, Burwell, both of United Kingdom

[73] Assignee: Masonlite Limited, Chatham, United Kingdom

[21] Appl. No.: 527,527

[22] Filed: Sep. 13, 1995

[30] Foreign Application Priority Data

Dec. 1, 1994 [GB] United Kingdom ..... 9424262

[51] Int. Cl.[6] ..... H01J 61/28

[52] U.S. Cl. ..... 313/565; 313/490; 313/546; 313/564; 313/562; 313/556

[58] Field of Search ..... 313/563, 490, 313/546, 550, 564, 562, 565, 549, 556, 561, 554, 491, 488, 492, 494, 558, 566, 594, 485

[56] References Cited

U.S. PATENT DOCUMENTS

| | | | |
|---|---|---|---|
| 1,071,418 | 3/1954 | Pessana . | |
| 3,297,898 | 1/1967 | Dobbins | 313/174 |
| 3,898,511 | 8/1975 | Johnson et al. . | |
| 4,308,650 | 1/1982 | Hernandez et al. . | |
| 4,335,326 | 6/1982 | Latassa et al. . | |
| 4,754,193 | 6/1988 | Hilmes et al. . | |
| 4,767,965 | 8/1988 | Yamano et al. . | |
| 4,823,047 | 4/1989 | Holmes et al. . | |
| 4,924,145 | 5/1990 | Buschmann . | |
| 5,256,935 | 10/1993 | Dobashi et al. . | |

FOREIGN PATENT DOCUMENTS

| | | |
|---|---|---|
| 2133509 | 10/1994 | Canada . |
| 0 063 393 | 10/1982 | European Pat. Off. . |
| 0 161 725 | 11/1985 | European Pat. Off. . |
| 0 626 716 A1 | 11/1994 | European Pat. Off. . |
| 1419098 | 12/1975 | United Kingdom . |
| 1475458 | 6/1977 | United Kingdom . |

*Primary Examiner*—Ashok Patel
*Attorney, Agent, or Firm*—Adams Law Firm, P.A.

[57] ABSTRACT

Apparatus for providing radiation includes an envelope and a cathode arrangement disposed within the envelope. The cathode arrangement includes an element for establishing an electrical contact. A dispenser is also disposed within the envelope. The dispenser carries mercury or a mercury alloy. A support element supports the dispenser. The support element extends from the dispenser through the envelope to provide an independent electrical contact for the dispenser.

10 Claims, 5 Drawing Sheets

APPARATUS FOR PROVIDING RADIATION

FIELD OF THE INVENTION

The present invention relates to apparatus for providing radiation, and more particularly, but not exclusively, to such apparatus containing a cold cathode, particularly activated cold cathodes.

DISCUSSION OF THE PRIOR-ART

Due to the ever more demanding legislation and recommendations for safety at work and the environment imposed by Government, manufacturers and users of lamps containing mercury have been required to adopt safer methods of construction, use and disposal of such lamps.

Currently it is common practice in the cold cathode lamp and sign industry to include up to 400 mg of unencapsulated mercury liquid. This is disadvantageous because mercury is a hazardous material.

An example of a prior art lamp is disclosed in U.S. Pat. No. 5,256,935, which discloses a low pressure mercury vapour discharge lamp having a cold cathode. A disadvantage of such lamps is that cathodes cannot be coated with an "emitter" coating for "activation" by heat treatment, as this would lead to premature release of mercury.

SUMMARY OF THE INVENTION

According to one aspect of the present invention there is provided apparatus for providing radiation comprising a sealed envelope for containing a gas, a cathode arrangement disposed within the envelope, and a source of a vapour capable of emitting radiation disposed within the envelope, wherein the vapour source is so disposed relative to the cathode arrangement so as substantially to avoid being heated during heat treatment of the cathode arrangement.

Preferably, the cathode arrangement is a cold cathode. The cold cathode may be in the form of a hollow cylinder which may have a substantially semi-cylindrical base.

Holding means may be provided in the envelope to hold the cathode arrangement in the envelope. The cathode may be a hollow cathode having a cylindrical configuration. The hollow cathode may be coated internally with an electron emissive material. The envelope preferably has an inner fluorescent coating.

Preferably the cathode arrangement is disposed at a spaced location from the vapour source. The vapour source may be a source of mercury vapour.

A shield may be arranged between the cathode arrangement and the vapour source to obviate or mitigate radiative heating of the vapour source by heat dissipated whilst heat treating the cathode arrangement. The shield may be in the form of a sheet which is supported by a wire on the cathode. Preferably, the sheet is formed of nickel. Alternatively, the shield may be in the form of a disc which is mounted on the support for the cathode arrangement. The disc may be formed of a ceramic material. The disc may alternatively be formed of mica or a metal.

The vapour source may comprise a capsule which may be sealed, preferably by a sealing process. The sealing process may be a process which involves crimping, welding or brazing the capsule in order to seal the capsule. The process may involve a combination of two or more of the steps of crimping, welding and brazing the capsule.

The seal preferably is adapted to rupture or melt at a temperature greater than the temperature present during heat treatment of the cathode arrangement (hereinafter referred to as the "rupturing point" or "melting point" as appropriate). The capsule may have liquid mercury and argon gas sealed therein. Alternatively, the capsule may contain mercury in a vaacuum. The capsule may be formed of nickel or iron and may be secured to the wire by a crimping or welding type connection. The wire may be mounted on or through a wall of the envelope to extend therein to and may be Formed of dumet or nickel bonded to dumet. Alternatively, the capsule may be formed of glass adapted to break or melt on heat treatment thereof. A wire may extend from one end thereof and may also extend through the capsule.

In a further embodiment, the vapour source may comprise a dispenser. The dispenser may comprise a head adapted to carry mercury or mercury alloy. The head may comprise first and second opposite faces. At least one of said faces may carry the mercury or mercury alloy. Means for absorbing impurity gases may also be provided. Said absorbing means may comprise a getter, which may be in the form of a suitable metal alloy and may be mounted either on the dispenser head or separately to the dispenser head. Where the absorbing means is mounted on the dispenser head, it is preferably mounted on the opposite race to the face carrying the mercury or mercury alloy. The cathode arrangement and the vapour source may be disposed at one end region of the envelope. Preferably, said end region is sealed and a stem may extend from said end region.

It is an advantage of the preferred embodiment of the present invention that it provides ruggedisation for cathode lamps which are required to operate with a high degree of reliability whilst in an extreme vibrating environment. Also, the provision of a getter to remove impurities has the advantage of increasing the life of the apparatus. A further advantage of the preferred embodiment of the present invention is that the vapour source is separated physically from the cathode, thus preventing heat treatment of the cathode causing premature release of the vapour.

The apparatus may include support means for supporting the dispenser. The support means may comprise a wire which may be sealed into the stem of the envelope. The wire may protrude from the stem.

Locating means may be provided on the wire within the stem to maintain the position of the vapour source in the envelope. The locating means is preferably in the form of a bead.

The support means may comprise a single wire extending to, or through, the envelope. Alternatively, the support means may comprise first and second wires to define a substantially U-shaped support for the dispenser, wherein both wires extend through the envelope. Where the wire or wires extend through the envelope, there is the advantage that an independent electrical contact is provided, thereby permitting separate heat treatment of the dispenser, by for example, ion bombardment. In the preferred method of processing the apparatus, the cathode is heat treated prior to the dispenser.

In a further embodiment, the dispenser may comprise a container assembly which may be supported by the support means being mounted on said holding means, or alternatively the support means may be mounted on the envelope. Preferably, the container assembly is adapted to hold pellets of mercury or mercury alloy and may be positioned such as to retain said pellets therein when the apparatus is inverted. The pellets may be located in the stem of the envelope during the construction of the apparatus and prior to the apparatus being inverted. The container assembly may be formed of nickel or alternatively may be formed of iron and may have solid or mesh walls.

The holding means for the cathode arrangement may preferably comprise an elongate rigid member having a pair of spaced legs which are sealed through a wall of the envelope. Preferably the free ends of the legs are accessible externally of the envelope, the opposite ends of the legs, being within the envelope, are conveniently joined together to form a substantially U-shaped construction, on which is mounted the cold cathode. The pair of spaced legs within the envelope may be twisted through an angle of at least , preferably between 90° and 180°, more preferably 90° or 180°, whereby to provide a mounting for the cathode arrangement which can better withstand the effects of vibration. Alternatively the cathode arrangement may comprise a single leg which is sealed through a wall of the envelope. One end of the leg is desirably accessible externally of the envelope, and the other end of the leg, within the envelope, may be formed to provide an intermediate portion in which is mounted the cold cathode. The elongate strand may be formed of dumet, or nickel and dumet wires and may be electrically insulated with a ceramic, glass or silica material.

Where the apparatus comprises a disc for shielding, the elongate strand may pass through apertures therein with the disc being supported on shoulders formed in the wire.

The hollow cathode may comprise strengthening means provided thereon which may be in the form of a collar around the cathode. The collar may be of a size so as to provide minimum spacing between the peripheral edges of the collar and the internal surface of the envelope. The collar may be formed of a ceramic material.

According to another aspect of the invention there is provided a method of manufacturing apparatus for providing radiation, said method comprising holding in an envelope a cathode arrangement, supporting in said envelope a vapour source, performing a first heating step to heat the cathode arrangement, thereafter performing a second heating step to heat the vapour source to release the vapour into the cathode, wherein the vapour source is so disposed relative to the cathode arrangement so as substantially to avoid being heated during said first heating step.

BRIEF DESCRIPTION OF THE DRAWINGS

Embodiments of the invention will now be described, by way of example only, with reference to the accompanying drawings, in which.

DETAILED DESCRIPTION

Figure 1:
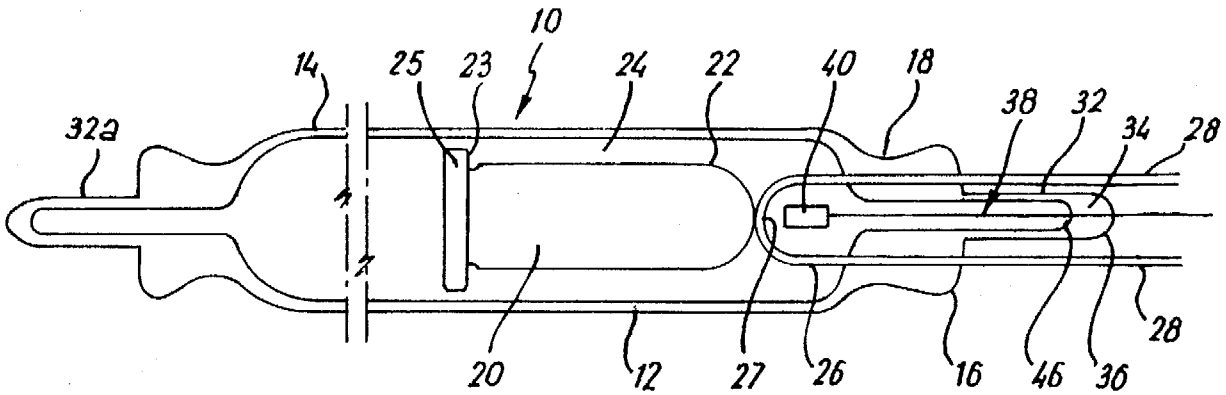
FIG. 1 is a schematic side elevation of apparatus for providing radiation.
Figure 2:
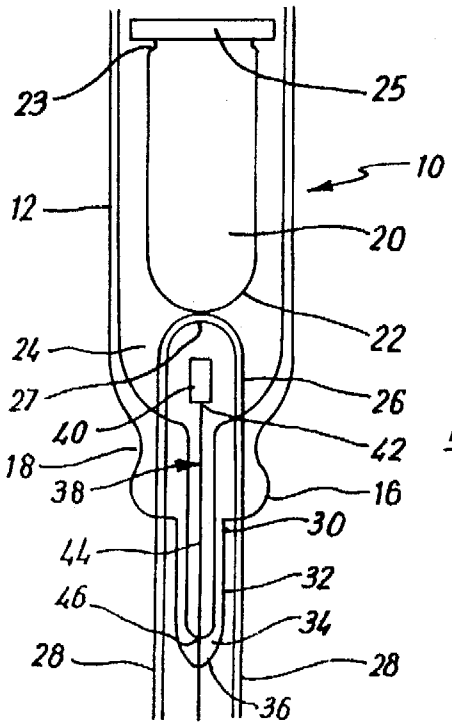
FIG. 2 is a side elevation view of one end region or the embodiment shown in FIG. 1.

Referring to FIGS. 1 and 2, there is shown apparatus for providing radiation in the form of a cold cathode mercury discharge lamp 10 which comprises a hollow tubular glass gas envelope 12 having a circular cross-section, and first and second ends 14 and 16. The second and 16 is sealed by a pinch seal 18.

A cylindrical hollow cold cathode 20, usually having a domed finished first end 22 is mounted within the cavity 24 or the envelope 12 and situated such that the cathode 20 extends along the longitudinal axis of the envelope 12 and the first end of the cathode 22 is positioned nearest the second end 16 of the envelope 12. The cathode 20 has a second end 23 around which is provided a collar 25.

The cathode 20 is mounted on a holder in the form of a cathode support 26 formed of dumet or nickel and dumet elongate member which is insulated by a ceramic material, having a pair of spaced legs 28 which are sealed through the second end 16 of the envelope 12, such that a portion of the legs 28 are accessible external to the envelope 12. The cathode support 26 also has an internal region 27, and supports the cathode 20 at the region 27. The cathode support 26 is in the form of an approximate U-shape. The pair of spaced legs 28 within the envelope 12 can be twisted through an angle of at least 90°, preferably 90° to 180°, more preferably 90° or 180°, at the internal region 27 to provide a mounting for the cathode 20 which can better withstand the effects of vibration (see FIG. 3).

In the embodiment shown in FIGS. 1 and 2, at the second end 16 of the envelope 12, there is attached the first end 30 of a hollow cylindrical glass sheath 32 which is situated so as to be in parallel relationship with and in between the legs 28, such that the sheath 32 extends away from the envelope 12. The first end 30 of the sheath 32 is attached to the envelope 12 so that the sheath 32 opens into the cavity 24 of the envelope 12 and the second end 34 is sealed at 36. A further sheath 32*a* is provided as an exhaust tubulation at the opposite end of the envelope 12 (see FIG. 1).

Figure 4:
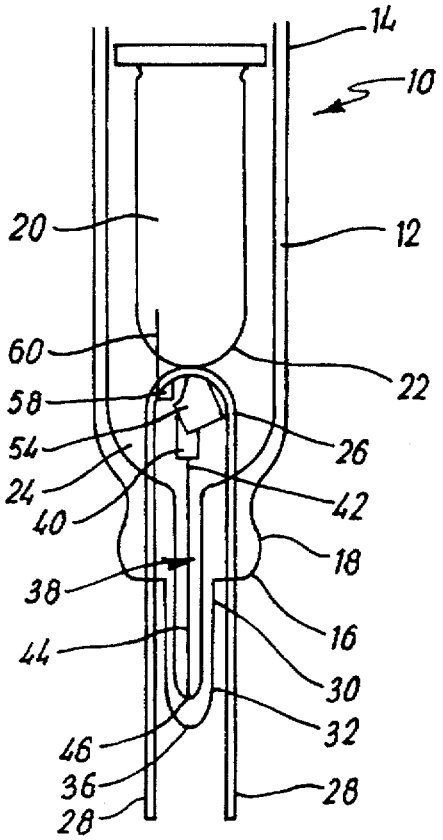
FIG. 4 is a sidle elevation view similar to FIG. 1 of another embodiment showing a first method of reducing the heat transfer between the cathode and the dispenser during activation of the cathode.
Figure 5:
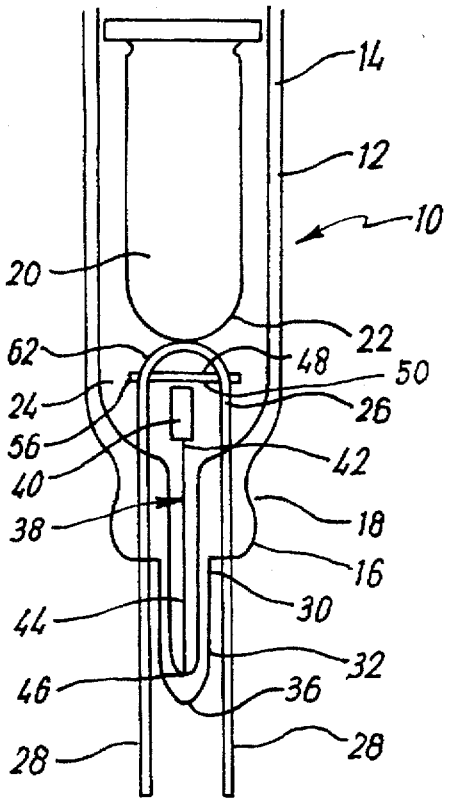
FIG. 5 is a side elevation view similar to FIG. 1 or a further embodiment showing a second means of reducing the heat transfer between the cathode and the dispenser.
Figure 5A:
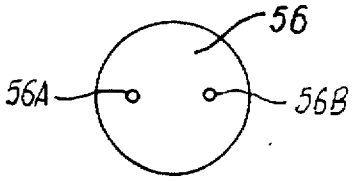
FIG. 5*a* is a schematic top plan view of the heat transfer reducing means shown in FIG. 4.

A dispenser 38 comprises a nickel, iron or stainless steel dispenser head 40, and is attached to the first end 42 of a dispenser support 44 formed from dumet or nickel and dumet wire. The dispenser 38 is mounted within the sheath 32 such that the first end 42 of the dispenser support 44 extends partially into the cavity 24 of the envelope 12 and the second end 46 of the dispenser support 44 is retained by either extending through or terminating within the seal 36 at the second end 34 of the sheath 32 (as shown in FIGS. 4 and 5).

Figure 2A:
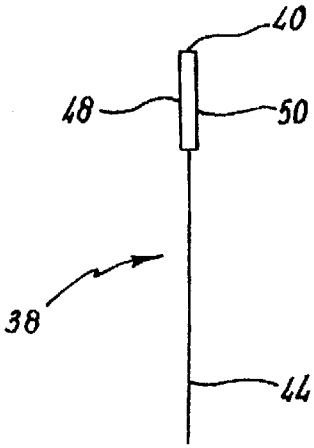
FIG. 2*a* is a side elevation view of the dispenser.

The dispenser head 40 has first and second flat faces 48 and 50 (see FIG. 2*a*), each face 48 and 50 having a plurality of surface indentations. A substrate of at least 5 mg of mercury alloy is applied to the first face 48 and a substrate of a getter material, e.g. a zirconium and aluminium alloy, applied to the second face 50, the indentations providing an improved adhesive surface for the substrates. A getter material is material capable of absorbing impurities from a gas which is contaminated, for example from the tubing or outgassing of the electrode, thereby providing the lamp with an extended lifespan.

The cavity 24 of the envelope 12 is evacuated via the further sheath 32*a* and a suitable gas introduced for example an argon end neon mixture, and the sheath 32*a* is then sealed.

The cathode 20 is activated in a conventional manner for example by ion bombardment in a gas discharge, so that when the cathode 20 is heated to a temperature which allows the cathode 20 to glow at red or orange heat, for example 750° C. to 1200°C., preferably 900° C., the dispenser head 40 is subsequently heated using separate heat treatment to a lower temperature, for example 800° C. to 900° C., preferably 850° C., for example by eddy current heating or ion bombardment. As there is a spaced relationship between the cathode 20 and the dispenser head 40, the dispenser head 40 is not heated at the same time as the cathode 20. Therefore, the mercury is not released from the dispenser head 40 before the cathode 20 has been activated and the envelope 12 outgassed. This also reduces the amount of getter material consumed if such a material is used.

Figure 3:
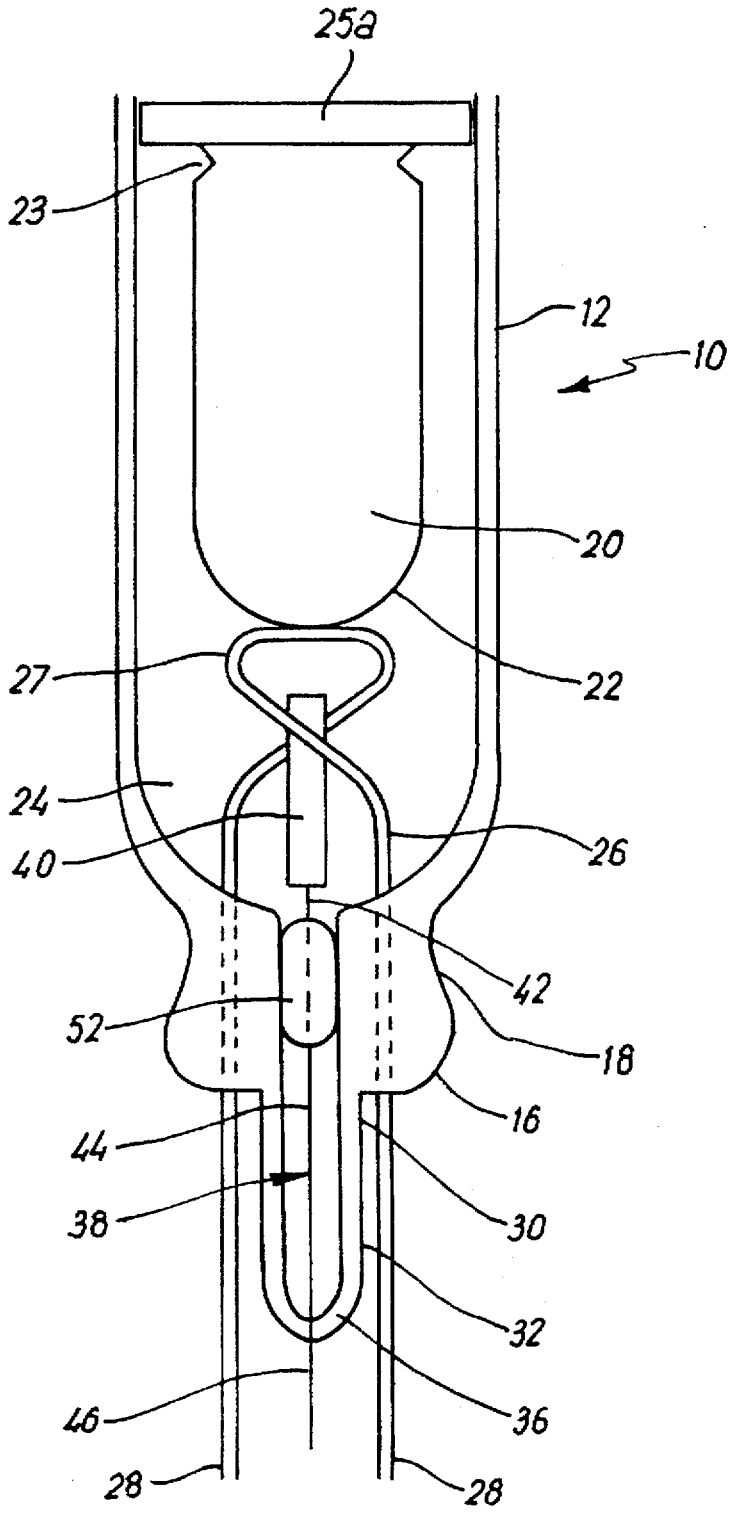
FIG. 3 is a side elevation view of one end region of another embodiment showing means of providing vibration damping and reducing thermal stress.

The reliability of the apparatus may also be improved by including a glass bead 52 and heat shields 54 and 56 as illustrated in FIGS. 3, 4 and 5.

FIG. 3 shows another embodiment, similar to that shown in FIGS. 1 and 2 but comprising a glass bead 52 which is of a diameter so as to fit within the sheath 32 and is formed about the dispenser support 44. The bead is positioned between the first and second ends 42 and 46 of the dispenser support 44 so thermal stress exerted on the pinched seal 18 is reduced when the dispenser 38 is activated and to centralise the dispenser head 40.

The cathode support 26 is twisted by substantially 180° at the top region 27 as shown in FIG. 3. This provides a degree of ruggedisation and improves the resistance to vibration, of the apparatus 10. As indicated previously, the cathode support can be twisted by at least 90°, preferably between 90° and 180°, more preferably 90° or 180° at the region 27 to provide the resistance to vibration.

The second end 23 of the cathode shown in FIG. 3 is collar 25*a*, which is similar to the collar 25 as shown in FIGS. 1 and 2 but is larger and extends closer to the envelope 12. This provides a further degree of ruggedisation to the cathode 20. The collar 25*a* is a ceramic collar and is of a size to provide minimum spacing between the peripheral edges of the collar 25*a* and the envelope 12.

FIG. 4 illustrates a heat shield 54 positioned below the cathode 20 and above the dispenser 38 to protect the dispenser head 40 from heat dissipated by the cathode 20 during activation. As illustrated, a heat shield 54 is provided by attaching a nickel plate 58 to the cathode 20 with an L-shaped support 60.

An alternative method of providing a heat shield is illustrated in FIG. 5. The spaced-legs 28 of the cathode support 26 are shaped so as to form shoulders 62 by reducing the spaced relationship between the legs 28 at an equal distance from the pinched seal 18. A ceramic, mica or metal disc 56 defines two apertures 56A, 56B spaced on opposite sides of the centre of the disc extending from the first flat face 48 of the disc through to the second flat face 50.

Each leg 28 of the cathode support 26 is inserted into one of each of the apertures formed in the disc 56 and the disc disposed so as to engage with the shoulders 62 in the legs 28. The position of the heat shield now forming a thermal barrier between the heat dissipated during processing of the cathode 20 and the dispenser 38.

Further embodiments of the apparatus 10, is illustrated in FIGS. 6 to 9, in which the same features as those in FIGS. 1 to 5 have been designated with the same reference numerals. In the embodiments shown in FIGS. 6 to 9, the dispenser 38 comprises a container 64 supported between the legs 28 of the cathode support 26, at mounting points 66 in place of the head 40 as illustrated in FIG. 1. The container 64 and the mountings 66 can be formed of nickel, iron or stainless steel. Either pellets of a mercury alloy 68 or mercury alloy pellets and a suitable getter material may be retained within the container 64, the container 64 having the capacity to retain a weight of up to 400 mg.

Figure 7:
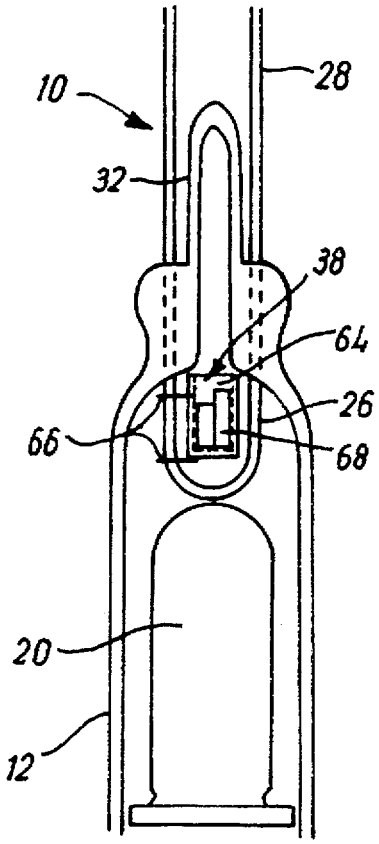
FIG. 7 is an inverted side elevation view of the embodiment shown in FIG. 6.

The mercury alloy pellets 68 are located within the sheath 32 during the construction of the apparatus 10, on the initial heating of the cathode 20. The apparatus 10 is then inverted, as illustrated in FIG. 7, such that the pellets 68 fall from the sheath 32 into the container 64, and the dispenser 38 is heated separately by eddy current heating to vapourise the mercury. The apparatus is activated as described above in the first embodiment.

Figure 8:
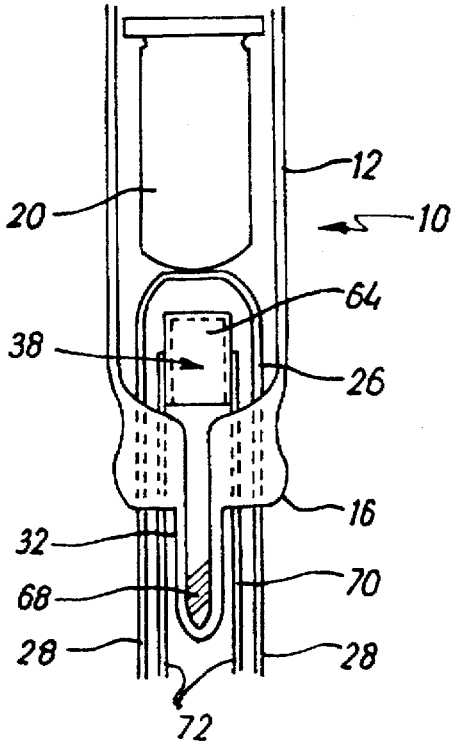
FIG. 8 is a side elevation view of a further embodiment showing alternative means for supporting the container assembly of the second embodiment.

The container 64 may alternatively be mounted on an independent support 70 having a pair of parallel spaced legs 72, as illustrated in FIG. 8. The legs 72 being sealed through the second end 16 of the envelope 12 and situated between the parallel spaced legs 28 of the cathode support 26.

The spaced legs 72 which extend through the envelope 12, as also in the case of other embodiments, provide independent electrical contacts thereby allowing separate heat treatment of the container 64 via the legs 72, as described above.

Figure 9:
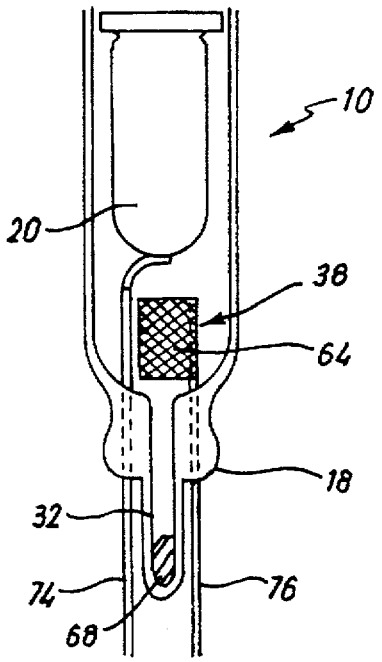
FIG. 9 is a side elevation view of a further embodiment showing further alternative means for supporting the container assembly of the embodiment shown in FIG. 8.

In a further embodiment, as illustrated in FIG. 9, the cathode support 26 may be modified such that it comprises a first leg 74 which is of a J-shape and provides support for the cold cathode. The support for the container assembly comprises a second leg 76. Both the first and second legs 74, 76 extend through the envelope 12 at the pinch seal 18.

Figure 6:
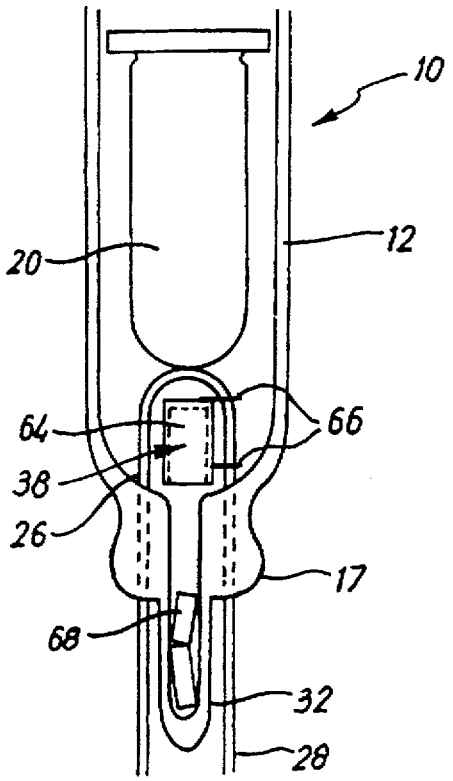
FIG. 6 is a side elevation view of a further embodiment of the apparatus.

The embodiments shown in FIGS. 8 and 9 are activated in a similar way to the embodiment shown in FIGS. 6 and 7, i.e. the cathode is heated initially with the apparatus in the position shown in FIGS. 8 and 9. The apparatus is then inverted for subsequent separate heating to vapourise the mercury, for example by ion bombarding.

Figure 10:
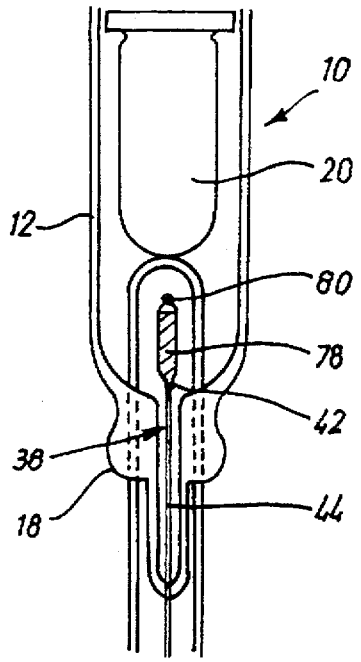
FIG. 10 is a side elevation view or another embodiment of the apparatus.
Figure 11:
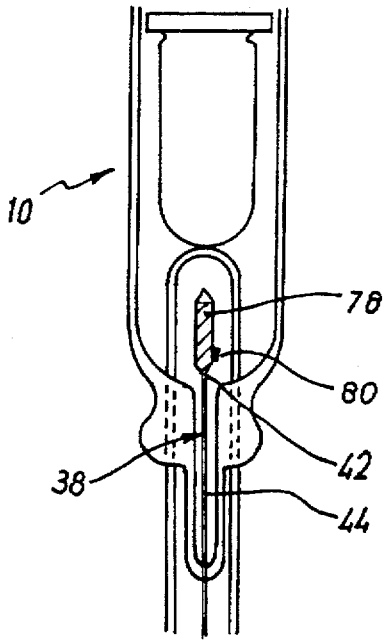
FIG. 11 is a side elevation view of another embodiment.

In further embodiments shown in FIGS. 10 and 11, the head 40, illustrated in FIG. 1, is replaced by a sealed metal capsule 78 crimped or welded to the first end 42 of the dispenser support 44. The capsule 78 is provided with a brazed, crimped or welded seal 80 (or a seal formed by a combination of two or more of the steps of brazing, crimping and welding) either at one end as illustrated in FIG. 10 or at a convenient location about the side of the capsule 78 as illustrated in FIG. 11. The material used to form the seal 80 has a rupturing or melting point greater than the temperature required in the construction of the apparatus 10 but less than the temperature Applied by separate heat treatment with either bombardment of eddy current heat to the dispenser 38. The capsule 78 is filled with liquid mercury under argon gas. Alternatively, the capsule 78 may contain mercury in a vacuum.

During processing the apparatus 10 is activated in a conventional manner as described above in relation to FIGS. 1 to 5. During the separate heat treatment of the capsule, for example by ion bombardment or eddy current heating the melting point of the material used to form a solely brazed seal 80 is exceeded, the seal melts and, the liquid mercury is released from within the capsule 78 into the envelope cavity 24. Alternatively, if the seal is formed by, for example, crimping or welding, the seal ruptures at a temperature exceeding the rupturing point of the seal.

Figure 12:
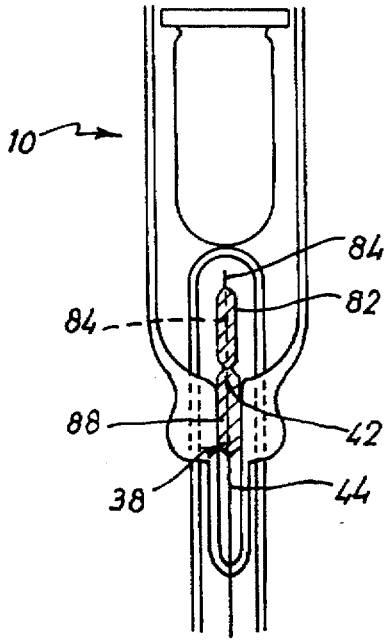
FIG. 12 is a side elevation view of another embodiment.

In the embodiment shown in FIG. 12, the metal capsule 78 shown in FIG. 11 is replaced by a glass capsule 82. The capsule may or may not have extending therefrom a metallic wire 84 to facilitate breakage of the glass and allow the mercury and argon contained in the capsule to be released. In another embodiment, the wire 84 extends through the capsule as shown by the dotted lines in FIG. 12.

The supporting wire 44 is provided with a glass and mica beading 88 (similar to the bead 52 in FIG. 3) to locate the wire in the stem, wherein the glass provides electrical insulation and the mica provides thermal protection for the glass to metal seal between the capsule 82 and the wire 44.

The internal surface of the envelope 12 can also be provided with a substrate or fluorescent material so as to convert ultraviolet radiation emitted from the apparatus to visible radiation. If no fluorescent substrate is provided the envelope 12 can be filled with neon or other inert gases.

Various modifications may be made to the apparatus described above) without departing from the scope of the present invention. For example, the dispenser head 40 need not be a flat nickel plate. It could alternatively, for example be a hollow tube with a circular cross-section. The two faces 48 and 50 of the flat plate being replaced by a cylindrical hollow tube filled with mercury alloy, either with or without a getter material.

A further alternative may for example employ only pellets of a mercury alloy applied to both the opposing faces of the dispenser head 40, foregoing the requirement for either mercury and getter substrates or an integrated mercury and getter substrate.

Thus, the embodiments shown have the advantages that the vapour source can be a stand alone item for use by manufacturers in their own lamps. A further advantage is that the dispenser can be heated separately from the cathode. Further, since the dispenser is spaced from the cathode, the dispenser is not heated by the heat treatment of the cathode. Another advantage is that it is possible to use the same heat treatment apparatus for the dispenser as for the cathode, thereby reducing costs. A farther advantage is that, the amount of mercury can be reduced to 5 mg. This enables cold cathode lamps to be manufactured which conform to present regulations and, also, reduces costs.

Another advantage is that the addition of mercury can be controlled to various levels which allows better control of the lesser amounts to conform to environmental regulations. The provision of a capsule of mercury allows use of larger amounts more common in the sign industry.

The ability to control the addition of mercury provides the advantage that it allows the use of small amounts of mercury where lamp or sign size permits.

A further advantage is that the use of a sealed capsule of mercury by customers making their own lamps is that there is the Avoidance of inhalation of mercury.

Whilst endeavouring in the foregoing Specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

We claim:

1. Apparatus for providing radiation comprising:

an envelope;

a cathode arrangement disposed within said envelope and including means for establishing an electrical contact for the cathode arrangement;

a dispenser also disposed within the envelope, said dispenser carrying mercury or a mercury alloy;

support means to support the dispenser, the support means extending from the dispenser through the envelope to provide an independent electrical contact for the dispenser.

2. Apparatus according to claim 1, wherein the dispenser comprises a head defining first and second opposite sides and adapted to carry mercury or mercury alloy.

3. Apparatus according to claim 2, wherein the first side carries the mercury or mercury alloy, and the second side carries absorbing means to absorb impurities.

4. Apparatus according the claim 1, wherein the dispenser comprises a container assembly adapted to contain mercury or mercury alloy.

5. Apparatus according to claim 4, wherein the container is formed of iron and comprises solid or mesh walls.

6. Apparatus according the claim 1, wherein the dispenser is in the form of a sealed capsule.

7. Apparatus according to claim 6, wherein the capsule is formed of a metal, the seal having a melting or rupture point greater than the temperature of heat treatment of the cathode and less than the temperature of heat treatment of the vapor source.

8. Apparatus according to claim 1, wherein the dispenser is in the form of a glass capsule adapted to break or melt on heat treatment thereof.

9. Apparatus according to claim 8, wherein the glass capsule has a wire extending therefrom to facilitate breakage or melting of the capsule during heat treatment thereof.

10. Apparatus according to claim 9, wherein the wire extending from the capsule also extends through the capsule.

* * * * *